US011174623B2

(12) United States Patent
Fukuda et al.

(10) Patent No.: US 11,174,623 B2
(45) Date of Patent: Nov. 16, 2021

(54) FLOW RATE CONTROL VALVE

(71) Applicant: KUBOTA CORPORATION, Osaka (JP)

(72) Inventors: Yuji Fukuda, Osaka (JP); Yoshimitsu Tanaka, Osaka (JP); Yasushi Otagaki, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/950,308

(22) Filed: Nov. 17, 2020

(65) Prior Publication Data

US 2021/0198869 A1 Jul. 1, 2021

(30) Foreign Application Priority Data

Dec. 28, 2019 (JP) ..... JP2019-239969

(51) Int. Cl.
*E02F 9/22* (2006.01)
*E02F 9/20* (2006.01)

(52) U.S. Cl.
CPC ..... *E02F 9/2267* (2013.01); *E02F 9/2004* (2013.01); *E02F 9/2221* (2013.01)

(58) Field of Classification Search
CPC ..... E02F 9/2225; E02F 9/2285; F15B 2211/30525; F15B 2211/3105; F15B 2211/3122; F15B 2211/3133; F15B 2211/31511
See application file for complete search history.

(56) References Cited

U.S. PATENT DOCUMENTS

2017/0175779 A1* 6/2017 Fukuda ..... F15B 11/16

FOREIGN PATENT DOCUMENTS

JP 2010-270527 A 12/2010
JP 6567395 8/2019

* cited by examiner

*Primary Examiner* — Abiy Teka
(74) *Attorney, Agent, or Firm* — Greenblum & Bernstein, P.L.C.

(57) ABSTRACT

A flow rate control valve includes a first flow line to connect to a first fluid line connected to a hydraulic actuator, a second flow line to connect to a second fluid line connected to the hydraulic actuator, a third flow line to connect to a third fluid line connected to a hydraulic pump, a fourth flow line to connect to an operation fluid tank or a fourth fluid line connected to a suction portion of the hydraulic pump, a fifth flow line to connect a first control valve and a second control valve, and a spool including a first connecting portion being configured to connect the first flow line and the third flow line at a first position and to connect the first flow line and the fifth flow line at a second position.

16 Claims, 5 Drawing Sheets

FLOW RATE CONTROL VALVE

CROSS-REFERENCE TO RELATED APPLICATIONS

The present application claims priority under 35 U.S.C. § 119 to Japanese Patent Application No. P2019-239969, filed Dec. 28, 2019. The content of this application is incorporated herein by reference in their entirety.

BACKGROUND OF THE INVENTION

Field of the Invention

The present invention relates to a flow rate control valve.

Description of Related Art

Conventional hydraulic systems for working device is known in Japanese Unexamined Patent Publication No. 2010-270527. The working device of Japanese Unexamined Patent Publication No. 2010-270527 is provided with a boom, a bucket, a boom cylinder that moves the boom, a bucket cylinder that moves the bucket, a first control valve that controls the stretching and shortening of the boom cylinder, and a second control valve that controls the stretching and shortening of the bucket cylinder. The hydraulic fluid outputted from a pump is supplied to the first control valve and second control valve.

SUMMARY OF THE INVENTION

A flow rate control valve includes: a first control valve; a second control valve; a first flow line to connect to a first fluid line connected to a hydraulic actuator; a second flow line to connect to a second fluid line connected to the hydraulic actuator; a third flow line to connect to a third fluid line connected to a hydraulic pump, the hydraulic pump being configured to output operation fluid; a fourth flow line to connect to an operation fluid tank or a fourth fluid line connected to a suction portion of the hydraulic pump, the operation fluid tank storing operation fluid; a fifth flow line to connect the first control valve and the second control valve, the fifth flow line through which operation fluid having flown through the first flow line and the second flow line flows; a spool including: a first connecting portion having a first position and a second position, the first connecting portion being configured to connect the first flow line and the third flow line at the first position and to connect the first flow line and the fifth flow line at the second position; and a second connecting portion to connect the second flow line and the third flow line at the second position; and a sixth flow line to connect the fourth flow line and the fifth flow line, the sixth flow line being arranged to a location other than the spool.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
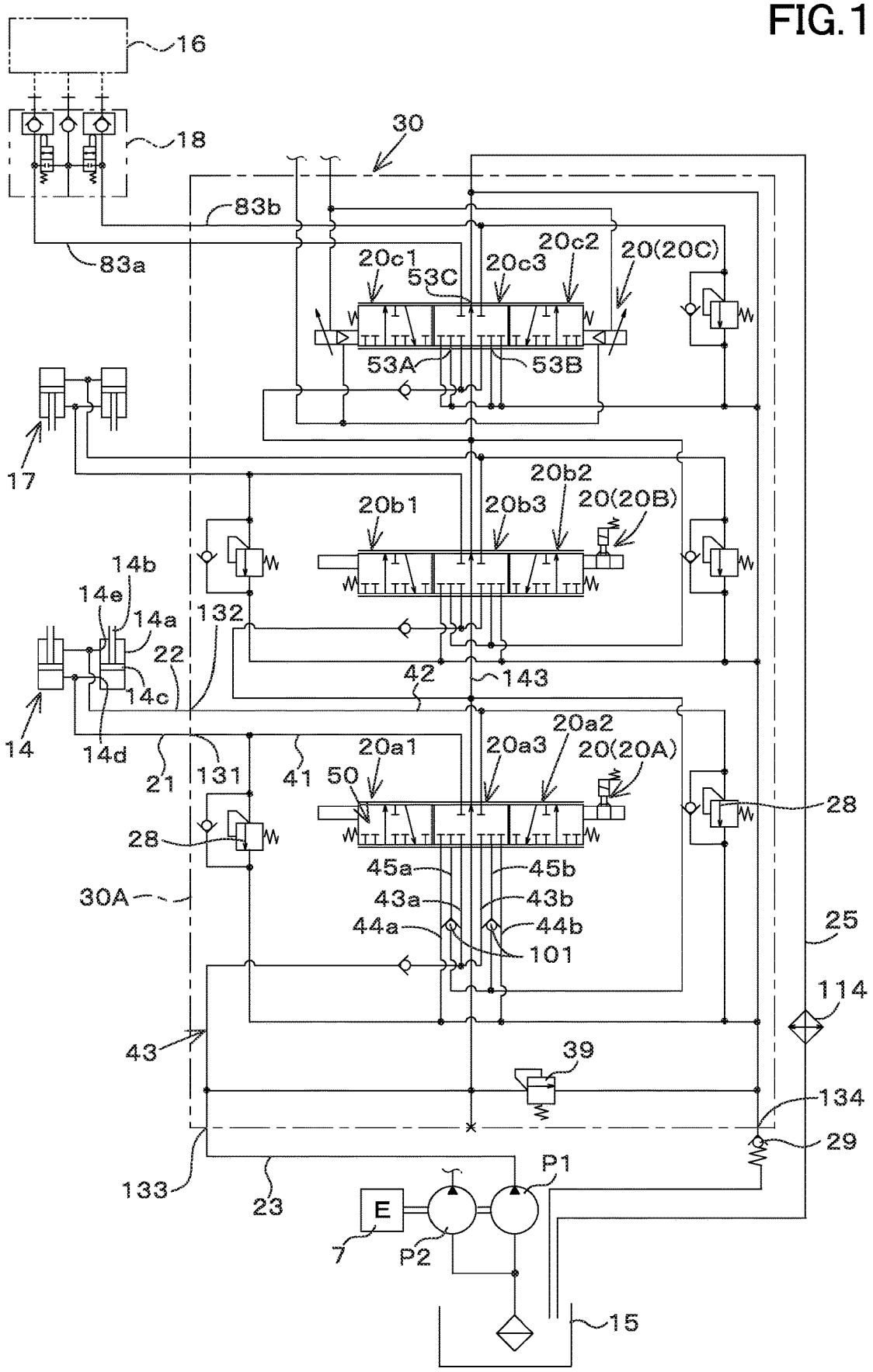
FIG. 1 is a schematic view of a working hydraulic system according to an embodiment of the present invention.

The embodiments of the present invention will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with appropriate reference to the drawings.

Figure 4:
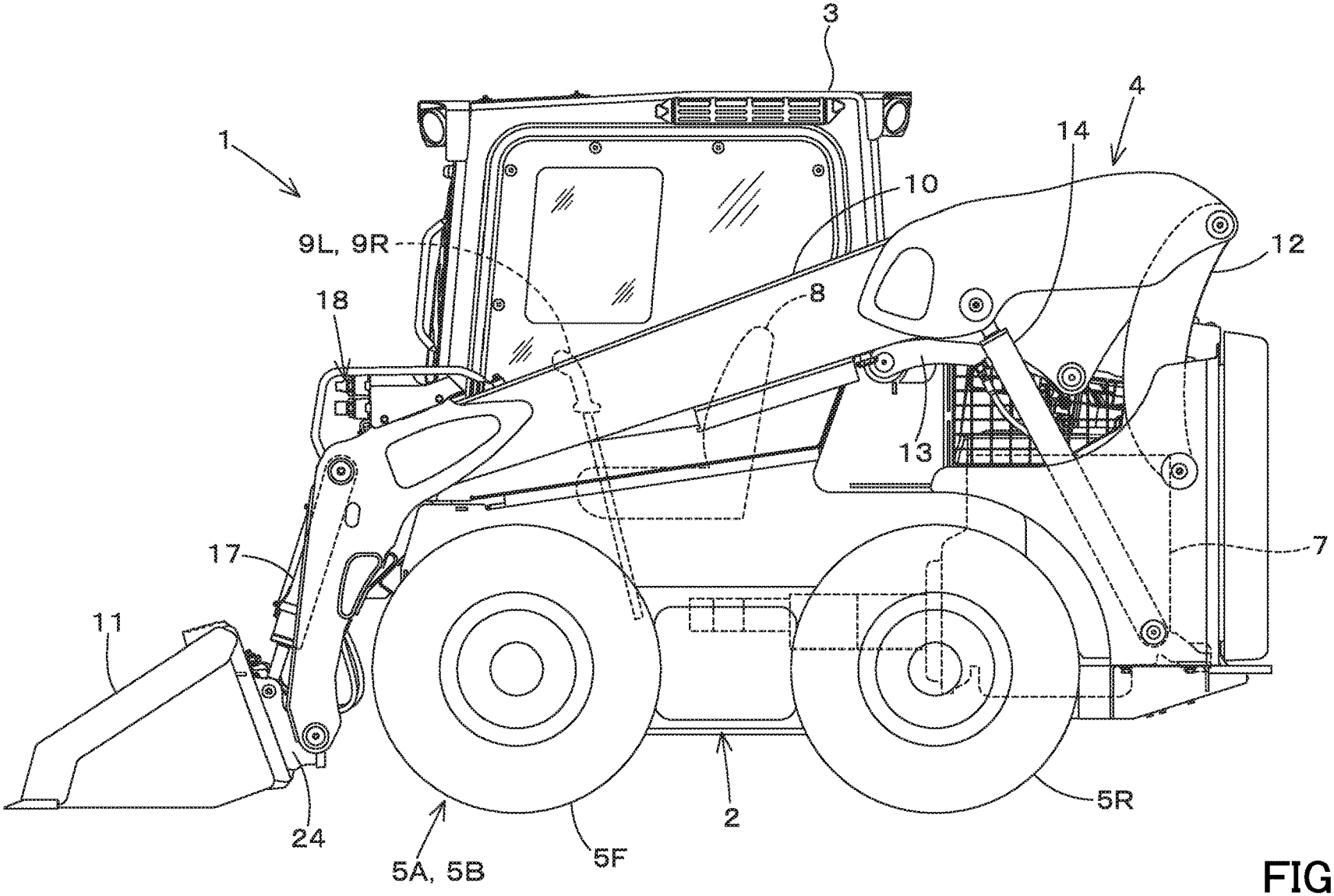
FIG. 4 is a whole view of a skid steer loader exemplified as a working machine according to an embodiment of the present invention.

FIG. 4 shows a side view of a working machine in accordance with the present invention. In FIG. 4, a skid steer loader is shown as an example of a working machine. However, the working device of the present invention is not limited to a skid steer loader and may be other types of loader working device, such as a compact track loader, for example. It may also be a working machine other than a loader working machine.

The working machine 1 is provided with a machine body (vehicle body) 2, a cabin 3, a working device 4, and traveling devices 5A and 5B.

The cabin 3 is mounted on the machine body 2. A operator seat 8 is provided at the rear portion of the cabin 3. In the embodiment of the present invention, the front side of an operator seated on the operator seat 8 of the working machine 1 (the left side in FIG. 4) is referred to as the front, the rear side of the operator (the right side in FIG. 4) is referred to as the rear, the left side of the operator (a front surface side of FIG. 4) is referred to as the left, and the right side of the operator (a back surface side of FIG. 4) is referred to as the right.

In addition, the lateral direction, which is a direction orthogonal to the front-rear direction, will be described as the machine width direction. The direction extending from the center portion of the machine body 2 toward the right portion or the left portion will be described as the machine outward direction. In other words, the machine outward direction is the machine width direction, that is, a direction separating away from the machine body 2.

The direction opposite to the machine outward direction will be described as the machine inward direction. In other words, the machine inward direction is the machine width direction, that is, a direction approaching the machine body 2.

The cabin 3 is mounted on the machine body 2. The working device 4 is a device for performing work, and is mounted on the machine body 2. The traveling device 5A is a device for traveling the machine body 2, and is installed on the left side of the machine body 2. The traveling device 5B is a device for traveling the machine body 2, and is installed on the right side of the machine body 2.

A prime mover 7 is provided at the rear portion of the machine body 2. The prime mover 7 is a diesel engine (engine). The motor 7 is not limited to an engine and may be an electric motor or the like.

A travel lever 9L is provided on the left side of the operator seat 8. A traveling lever 9R is provided on the right side of the operator seat 8. The traveling lever 9L on the left side operates the left-side traveling device 5A, and the right-side traveling lever 9R operates the right-side traveling device 5B.

The working device 4 has a boom 10, a bucket 11, a lift link 12, a control link 13, a boom cylinder 14, and a bucket cylinder 17.

The boom 10 is provided on the side of the machine body 2. A bucket 11 is provided at the end (front end) portion of the boom 10.

The lift link 12 and control link 13 support the base (rear) portion of the boom 10. The boom cylinder 14 moves the boom 10 up or down.

In detail, the lift link 12, the control link 13 and the boom cylinder 14 are provided on the side of the machine body 2. The upper portion of the lift link 12 is pivoted to the upper portion of the base of the boom 10. The lower portion of the lift link 12 is pivoted to the side of the rear portion of the machine body 2.

The control link 13 is located forward of the lift link 12. One end of the control link 13 is pivoted to the bottom of the base of the boom 10 and the other end is pivoted to the machine body 2.

The boom cylinder 14 is a hydraulic cylinder that raises and lowers the boom 10. The upper portion of the boom cylinder 14 is pivoted to the front of the base of the boom 10. The lower portion of the boom cylinder 14 is pivoted to the rear side of the machine body 2. When the boom cylinder 14 is extended and shortened, the boom 10 is pivoted up and down by the lift link 12 and the control link 13.

The bucket cylinder 17 is a hydraulic cylinder that pivots the bucket 11. The bucket cylinder 17 connects the left portion of the bucket 11 to the left boom and also connects the right portion of the bucket 11 to the boom provided to the right.

In place of the bucket 11, auxiliary attachments such as hydraulic crushers, hydraulic breakers, angle brooms, augers, pallet forks, sweepers, mowers, snow blowers, and the like can be attached to the end (front) portion of the boom 10.

The traveling devices 5A and 5B are wheel-type traveling devices 5A and 5B having front wheels 5F and rear wheels 5R in this embodiment. Crawler-type (including semi-crawler-type) traveling devices 5A and 5B may be employed as the traveling devices 5A and 5B.

Next, the working hydraulic circuit (working hydraulic system) provided in the skid steer loader 1 will be described.

As shown in FIG. 1, the working hydraulic system is a system for operating the boom 10, the bucket 11, the auxiliary attachments and the like, and is provided with a flow control valve 30 and a hydraulic pump (first hydraulic pump) P1 of the working system. It is also provided with a second hydraulic pump P2, which is different from the first hydraulic pump P1.

The first hydraulic pump P1 is a pump to be operated by the power of the prime mover 7 and is constituted of a gear pump of a constant displacement type (a fixed displacement type). The first hydraulic pump P1 is capable of outputting hydraulic fluid stored in a tank (hydraulic fluid tank) 15.

The second hydraulic pump P2 is a pump operated by the power of the prime mover 7 and is composed of a gear pump of a constant displacement type (a fixed displacement type). The second hydraulic pump P2 is capable of outputting hydraulic fluid stored in a tank (hydraulic fluid tank) 15.

The second hydraulic pump P2 discharges hydraulic fluid for signals and hydraulic fluid for control in the hydraulic system. The hydraulic fluid for signals and control fluid is referred to as pilot fluid.

The flow control valve 30 is a valve that controls various hydraulic actuators installed in the working device 1. A hydraulic actuator is a device to be operated by hydraulic fluid and is a hydraulic cylinder, hydraulic motor, and the like.

In this embodiment, the flow control valve 30 has a first control valve 20A, a second control valve 20B, a third control valve 20C, and a main body 30A including the first control valve 20A, the second control valve 20B and the third control valve 20C.

First, the second control valve 20B and the third control valve 20C will be described.

The second control valve 20B is a valve that controls the hydraulic cylinder (bucket cylinder) 17 that controls the bucket 11. The third control valve 20C is a valve that controls the hydraulic actuator (hydraulic cylinder, hydraulic motor, and the like) 16 mounted on the auxiliary attachment.

The second control valve 20B is a direct-acting spool three-position switching valve of pilot type, respectively. The second control valve 20B switches between a neutral position 20*b*3, a first position 20*b*1 different from the neutral position 20*b*3, a second position 20*b*2 different from the neutral position 20*b*3 and the first position 20*b*1.

In the second control valve 20B, the neutral position 20*b*3, the first position 20*b*1 and the second position 20*b*2 are switched by moving the spool through operation of the operation member. A bucket cylinder 17 is connected to the second control valve 20B via a fluid line.

Thus, when the second control valve 20B is set to the first position 20B1 through operation of the operation member, the bucket cylinder 17 is shortened. Due to the shortening of the bucket cylinder 17, the bucket 11 performs a scooping operation. When the second control valve 20B is set to the second position 20*b*2 through operation of the operation member, the bucket cylinder 17 is extended.

The bucket cylinder 17 is extended, and the bucket 11 performs a dumping operation. The switching of the second control valve 20B is performed by moving the spool directly with the operation member, but the spool may also be moved by the pressure of the hydraulic fluid (pilot fluid).

The third control valve 20C is a direct-acting spool-type three-position switching valve of pilot-type, respectively. The third control valve 20C is switched between a neutral position 20C3, a first position 20C1 different from the neutral position 20C3, and a second position 20C2*a* different from the neutral position 20C3 and the first position 20C1.

In the third control valve 20C, the switching of the neutral position 20C3, the first position 20C1 and the second position 20C2 is performed by moving the spool with the pressure of the pilot fluid.

A connector member 18 is connected to the third control valve 20C via supply-drain fluid lines 83*a* and 83*b*. The connector member 18 is connected to the connector member 18 with a fluid line connected to the hydraulic actuator 16 of the auxiliary attachment.

Thus, when the third control valve 20C is set to the first position 20*c*1, hydraulic fluid can be supplied from the supply-drain fluid line 83*a* to the hydraulic actuator 16 of the auxiliary attachment. When the third control valve 20C is set to the second position 20c2, hydraulic fluid can be supplied to the hydraulic actuator 16 of the auxiliary attachment from the supply-drain fluid line 83b.

Thus, the hydraulic actuator 16 (auxiliary attachment) can be operated by supplying hydraulic fluid to the hydraulic actuator 16 from the supply-drain fluid line 83a or the supply-drain fluid line 83b.

Next, the first control valve will be described.

As shown in FIG. 1, the first control valve 20A is a valve that can be applied to a series circuit. In a series circuit having an upstream control valve (for example, the first control valve 20A) and a downstream control valve (for example, the second control valve 20B), the hydraulic fluid (return fluid) returning from the hydraulic actuator to the first control valve 20A upon operation of the first control valve 20A will flow to the second control valve 20B.

The first control valve 20A is a valve capable of outputting a portion of the return fluid returned from the hydraulic actuator during actuation to a fluid line that outputs the hydraulic fluid.

The boom cylinder 14 is provided with a cylinder body 14a, a rod 14b movably provided in the cylinder body 14a, and a piston 14c provided in the boom cylinder 14. At the base end of the cylinder body 14a (opposite to the rod 14b side), a first supply-drain port 14d is provided for supplying and outputting the hydraulic fluid.

A second supply-drain port 14e is provided at the end of the cylinder body 14a (on the rod 14b side) for supplying and outputting the hydraulic fluid. One end of the first fluid line 21 is connected to the first supply-drain port 14d, and one end of the second fluid line 22 is connected to the second supply-drain port 14e.

That is, the second fluid line 22 is a fluid line that connects to the boom cylinder 14 at a different location from the first fluid line 21 connected to the boom cylinder 14. The first fluid line 21 and the second fluid line 22 are capable of flowing the hydraulic fluid and are formed of pipe material such as hydraulic hoses, pipes, fittings and the like.

As shown in FIG. 1, the first control valve 20A is a direct-acting spool-type three-position switching valve of pilot-type, respectively. The first control valve 20A is switched between a neutral position 20A3, a first position 20A1 different from the neutral position 20A3, and a second position 20A2 different from the neutral position 20A3 and the first position 20A1.

Figure 2A:
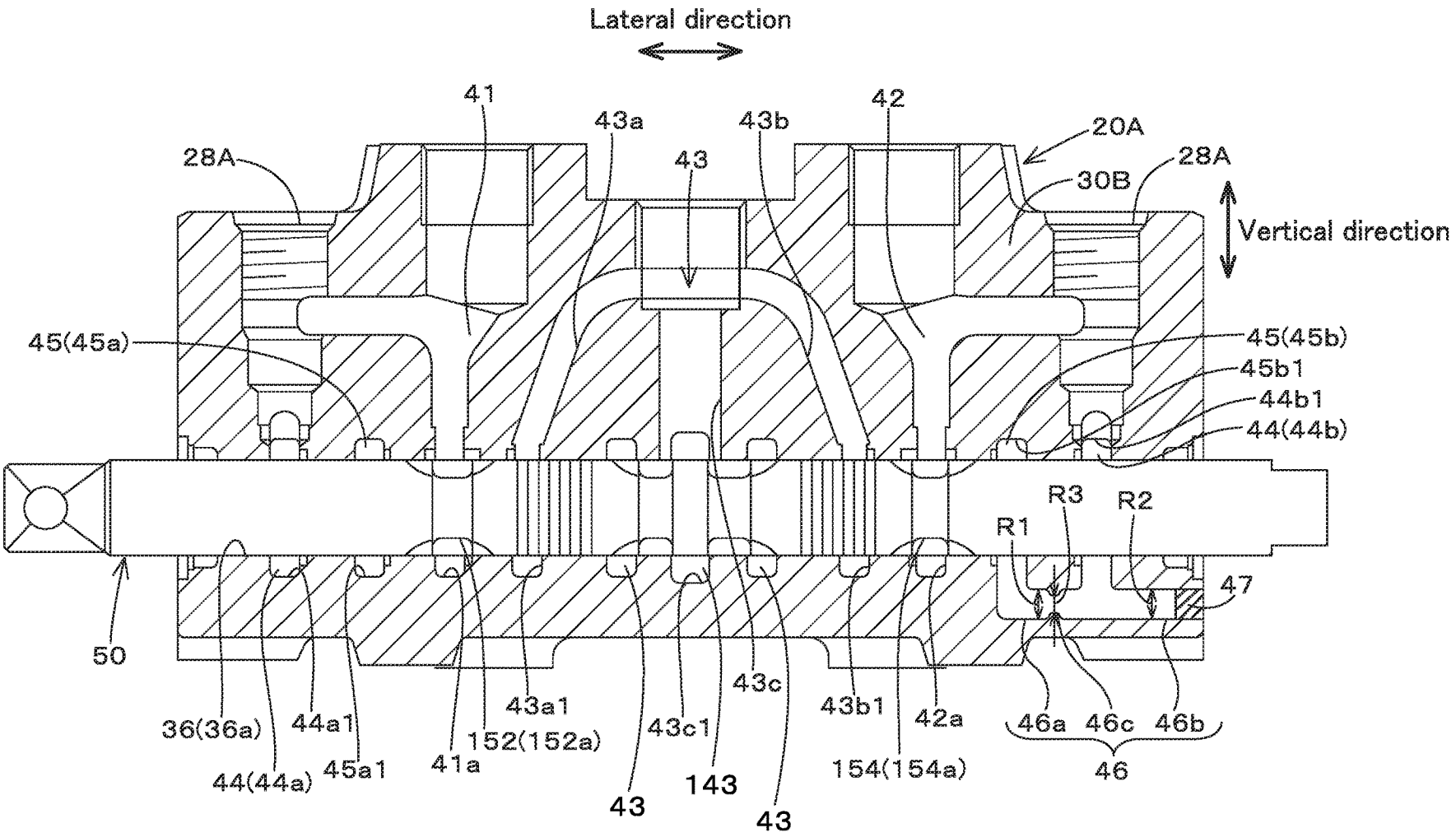
FIG. 2A is an internal view of a first control valve at a neutral position according to an embodiment of the present invention.

As shown in FIG. 2A, the first control valve 20A is formed in the main body 30A. The main body 30A is formed of a cast iron or resin. As shown in FIG. 1, the second control valve 20B and the third control valve 20C are also formed in the same main body 30A as the first control valve 20A.

That is, although the main body 30A is a common member of the first control valve 20A, the second control valve 20B and the third control valve 20C, a separate main body may be provided for each control valve 20.

The main body 30A corresponding to the first control valve 20A has a plurality of ports. As shown in FIG. 1, the plurality of ports includes a first body port 131, a second body port 132, a third body port 133, and a fourth body port 134.

The first main body port 131 is a port connecting the other end of the first fluid line 21 connected to the boom cylinder 14. Thus, the hydraulic fluid flowing from the first body port 131 to the boom cylinder 14 passes through the first fluid line 21 into the first supply-drain port 14d of the boom cylinder 14. The hydraulic fluid flowing from the first supply-drain port 14d to the first control valve 20A enters the first body port 131 through the first fluid line 21.

The second main body port 132 is a port connecting the other end of the second fluid line 22 connected to the boom cylinder 14. Thus, the hydraulic fluid flowing from the second body port 132 to the boom cylinder 14 passes through the second fluid line 22 and enters the second feed and drain port 14e of the boom cylinder 14.

The hydraulic fluid flowing from the second supply-drain port 14e to the first control valve 20A enters the second body port 132 through the second fluid line 22. The third main body port 133 is a port to which the third fluid line 23 connected to the first hydraulic pump P1, which discharges the hydraulic fluid, is connected.

As shown in FIG. 1, the fourth body port 134 is the port to which the fourth flow line 24 connected to the hydraulic fluid tank 15 is connected. A check valve 29 is provided in the fourth flow line 24 and a oil cooler 114 is provided in the fifth fluid line 25.

As shown in FIG. 2A, the main body 30A has a flow line for flowing the hydraulic fluid. That is, the main body 30A has a first flow line 41, a second flow line 42, a third flow line 43, a fourth flow line 44 and a fifth flow line 45. For convenience of explanation, in FIG. 2A, the left side of the paper is referred to as the left side, the right side of the paper is referred to as the right side, the left and right directions are referred to as the lateral direction, and the direction orthogonal to the lateral direction is referred to as the vertical direction.

The first flow line 41 is a flow line formed in the main body 30A and is connected to the first main body port 131. The first body port 131 is provided on the left portion of the main body 30A in the lateral direction, and the first flow line 41 is formed following the first body port 131. The first flow line 41 extends at least longitudinally.

The second flow line 42 is a flow line formed in the main body 30A and is connected to the second main body port 132. A second main body port 132 is provided at the right portion of the main body 30A in the lateral direction, and the second flow line 42 is formed following the second body port 132. The second flow line 42 extends at least longitudinally.

A relief valve 28 is connected to each of the portion 28A connected to the first flow line 41 and the portion 28A connected to the second flow line 42.

The third flow line 43 is a flow line formed in the main body 30A and is connected to the third body port 133. The third flow line 43 is formed in the center of the lateral direction of the main body 30A. In particular, the third flow line 43 includes a left flow line 43a, a right flow line 43b, and a central flow line 43c. The central flow line 43c is formed in the center of the main body 30A in the lateral direction.

The left flow line 43a is located to the left of the central flow line 43c. The right flow line 43b is located to the right of the central flow line 43c. The left flow line 43a is connected to the central flow line 43c and the right flow line 43b is connected to the central flow line 43c.

The fourth flow line 44 is a flow line formed in the main body 30A and is connected to the fourth body port 134. In particular, the fourth flow line 44 includes a left flow line 44A and a right flow line 44B.

The left flow line 44a is formed in the left part of the main body 30A in the lateral direction. The left flow line 44a is located to the left of the first flow line 41. The right flow line 44b is formed on the right portion of the main body 30A in the lateral direction. The right flow line 44b is located to the right of the second flow line 42.

The fifth flow line 45 is a flow line formed in the main body 30A that can be connected to another second control valve 20B that is different from the first control valve 20A. The fifth flow line 45 can be a flow line for connecting to a control valve different from the first control valve 20A.

The fifth flow line 45 includes a left flow line 45*a* and a right flow line 45*b*. The left flow line 45*a* is formed in the left part of the main body 30A in the lateral direction. The left flow line 45*a* is located between the first flow line 41 and the left flow line 44*a* of the fourth flow line 44.

The right flow line 45*b* is formed in the lateral right portion of the main body 30A. The right flow line 45*b* is located between the second flow line 42 and the right flow line 44*b* of the fourth flow line 44. The left flow line 45*a* and the right flow line 45*b* are connected, and the flow line 45*c* after the merging is connected to the second control valve 20B.

Now, an annular wall portion 36 (through hole 36*a*) extending from one end (left end) to the other end (right end) in the lateral direction of the main body 30A is formed. That is, the main body 30A is formed with a straight-line through hole 36*a* for inserting a spool 50 formed in a cylinder shape. A first flow line 41, a second flow line 42, a third flow line 43, a fourth flow line 44 and a fifth flow line 45 reach the annular wall portion 36 including the through hole 36*a*.

The end portion 41*a* of the first flow line 41 reaches the wall portion 36. The end portion 42*a* of the second flow line 42 reaches the wall portion 36. The end portion 43*a*1 of the left flow line 43*a* of the third flow line 43 reaches the wall portion 36. An end portion 43*b*1 of the right flow line 43*b* of the third flow line 43 reaches the wall portion 36. An end portion 43*c*1 of the central flow line 43*c* of the third flow line 43 reaches the wall portion 36.

The end portion 44*a*1 of the left flow line 44*a* of the fourth flow line 44 reaches the wall portion 36. The end portion 44*b*1 of the right flow line 44*b* of the fourth flow line 44 reaches the wall portion 36. An end portion 45*a*1 of the left flow line 45*a* of the fifth flow line 45 reaches the wall portion 36. The end portion 45*b*1 of the right flow line 45*b* of the fifth flow line 45 reaches the wall portion 36.

Each of the end portions 41*a*, 42*a*, 43*a*1, 43*b*1, 43*c*1, 44*a*1, 44*b*1, 45*a*1, and 45*b*1 is formed in a concave shape.

As shown in FIG. 2A, the first control valve 20A has a spool 50. The spool 50 can change the connection points of the first flow line 41, the second flow line 42, the third flow line 43, the fourth flow line 44 and the fifth flow line 45 by moving inside the main body 40.

The following is a detailed description of the spool 50.

The spool 50 is formed in a cylindrical shape. The cylindrical spool 50 is inserted into a through hole 36*a* formed in the main body 40. A left or right end portion of the spool 50 protrudes from the main body 40. An operation member such as a lever or the like is connected to the protruding portion (protruding portion) of the spool 50.

The spool 50 has a first connector portion 152 and a second connecting portion 154. The first connector portion 152 is capable of connecting the first flow line 41 to the fifth flow line 45. The first connector portion 152 is also capable of connecting the first flow line 41 and the third flow line 43.

In particular, the first connector portion 152 includes a first concave portion 152*a*. The first concave portion 152*a* is a portion formed by recessing an outer surface of the spool 50 in an annular manner. The spool 50 is moved to overlap (correspond) the first concave portion 152*a*, the end portion 41*a* of the first flow line 41 and the left flow line 43*a* (end portion 43*a*1) of the third flow line 43.

That is, when the first control valve 20A is in the first position 20A1, the first connector portion 152 can connect the first flow line 41 to the third flow line 43.

The spool 50 is moved to overlap (correspond) the first concave portion 152*a*, the end portion 41*a* of the first flow line 41 and the left flow line 45*a* (end portion 45*a*1) of the fifth flow line 45.

That is, when the first control valve 20A is in the second position 20*a*2, the first connector portion 152 can connect the first flow line 41 to the fifth flow line 45.

The second connecting portion 154 includes a second concave portion 154*a*. The second concave portion 154*a* is a portion formed by recessing the outer surface of the spool 50 in an annular pattern.

The spool 50 is moved to overlap (correspond) the second concave portion 154*a*, the end portion 42*a* of the second flow line 42 and the left flow line 43*a* (end portion 43*a*1) of the third flow line 43. That is, when the first control valve 20A is in the second position 20*a*2, the second connecting portion 154 can connect the second flow line 42 and the third flow line 43.

The spool 50 is moved to overlap (correspond) the second concave portion 154*a*, the end portion 42*a* of the second flow line 42 and the right flow line 45*b* (end portion 45*b*1) of the fifth flow line 45. That is, when the first control valve 20A is in the first position 20*a*1, the second connecting portion 154 can connect the second flow line 42 and the fifth flow line 45.

As shown in FIG. 2A, the flow control valve 30 is provided with a sixth flow line 46. The sixth flow line 46 is provided at a different location from the spool 50 and is a flow line connecting the fourth flow line 44 and the fifth flow line 45. The sixth flow line 46 is formed in the same body 30A as the first control valve 20A.

The sixth flow line 46 includes a first connector portion 46*a*, a second connector portion 46*b*, and a throttle portion 46*c*. The first connector portion 46*a* is provided on the right side and is connected to the right flow line 44*b* of the fourth flow line 44. The second connector portion 46*b* is provided on the right side as well as the first connector portion 46*a* and is connected to the right flow line 45*b* of the fifth flow line 45. The inner diameter R1 of the first connector portion 46*a* and the inner diameter R2 of the second connector portion 46*b* are set to be roughly the same as those of the first connector portion 46*a*.

The throttle portion 46*c* is a flow line connecting the right flow line 44*b* of the fourth flow line 44 and the right flow line 45*b* of the fifth flow line 45, and the inner diameter R3 is also reduced by the inner diameter R1 of the first connector portion 46*a* and the inner diameter R2 of the second connector portion 46*b*.

The right side of the first connector portion 46*a*, that is, the right side of the fourth flow line 44 from the right flow line 44*b*, extends to the outer end of the main body 30A, and the outer end side is closed by a closing member 47, such as a plug.

That is, the circuit can be easily configured by inserting a tool for machining the throttle portion 46*c* from the outer end of the first connector portion 46*a*, or by inserting a structure including the throttle portion 46*c*, the second connector portion 46*b*, and the closure member 47 from the outer end of the first connector portion 46*a*.

As shown in FIG. 1, the flow control valve 30 is provided with a first check valve 101. The first check valve 101 is provided in the middle of the right flow line 45*b* of the fifth flow line 45 and is a valve that permits hydraulic fluid to flow from the first control valve 20A to the second control valve 20B and prevents hydraulic fluid from flowing from the second control valve 20B to the first control valve 20A.

That is, the first check valve 101 is located downstream of the sixth flow line 46. Separate from the fifth flow line 45, a seventh flow line 143 is provided which is connected to the first control valve 20A and the second control valve 20B, and which can be connected to the fifth flow line 45. The first check valve 101 may be provided on the second control valve 20B side.

As described above, as shown in FIG. 1, the oil cooler 114 and the check valve 29 are provided to increase the pressure of the fourth flow line 44, which is connected to the drain fluid line. In addition, the hydraulic fluid in the drain fluid line can flow from the discharge ports 53A, 53B and 53C and the main relief 39 of the third control valve 20C to the second control valve 20B side through the fourth flow line 44, the sixth flow line 46 and the fifth flow line 45.

In other words, the oil cooler 114 and the check valve 29 can increase the back pressure in the drain fluid line, which enables the hydraulic fluid on the drain fluid line side to be supplied to the second control valve 20B, for example, when the return fluid from the first hydraulic actuator 14 to the first control valve 20A is low.

Figure 2B:
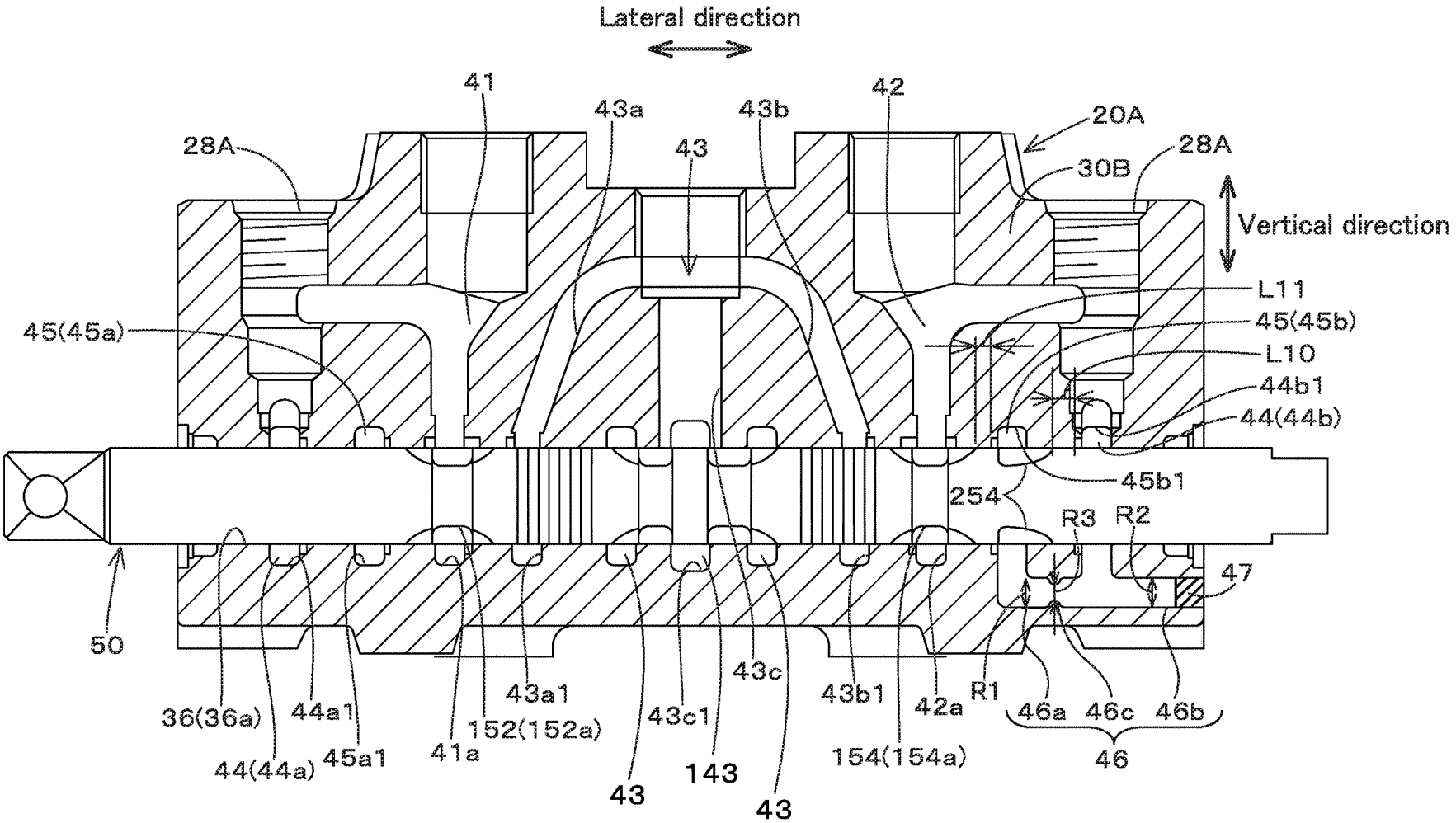
FIG. 2B is an internal view of a first control valve at a neutral position as a modified example of a first control valve of FIG. 2A according to an embodiment of the present invention.

FIG. 2B is a variation of the first control valve 20A (flow control valve 30) of FIG. 2A. As shown in FIG. 2B, the spool 50 has an auxiliary connector portion 254 formed in the spool 50. The auxiliary connector portion 254 is a portion that connects the fifth flow line 45 and the fourth flow line 44 by moving the spool 50.

The auxiliary connector portion 254 is configured by forming the outer surface of the spool 50 in a concave shape. In FIG. 2B, with the first control valve 20A in the neutral position 20*a*3, the axial distance L10 between the axial end of the fourth flow line 44 side of the auxiliary connector portion 254 and the end of the fourth flow line 44*b*1 is greater than the axial distance L11 between the end of the fifth flow line 45*b*1 and the second recessed portion 154*a*, so that the position of the auxiliary connector portion 254 is set.

Thus, as shown in FIG. 2B, when the spool 50 is gradually moved from the neutral position 20*a*3 to the second position 20*a*2, the second concave portion 154*a* connects with the end portion 45*b*1 of the fifth flow line 45 and the first connector portion 46*a* of the sixth flow line 46. This causes a portion of the hydraulic fluid (return fluid) of the first hydraulic actuator 14 (a portion of the return fluid that has passed through the second flow line 42) to flow through the squeezed portion 46*c* of the sixth flow line 46 to the fourth flow line 44.

Here, the return fluid flowing into the fourth flow line 44 is determined by the opening area (cross-sectional area) of the throttle portion 46*c*. In other words, when the spool 50 is gradually moved from the neutral position 20*a*3 to the second position 20*a*2, the flow rate of the return fluid flowing into the fourth flow line 44 is regulated to a predetermined amount by the throttle portion 46*c*.

On the other hand, when the spool 50 is further moved toward the second position 20*a*2, the fifth flow line 45 and the fourth flow line 44 are connected to the fifth flow line 45 by the auxiliary connector portion 254, with the second concave portion 154*a* reaching the fifth flow line 45.

In other words, the fifth flow line 45 is connected to the auxiliary connector portion 254 as well as the sixth flow line 46, and the return fluid flowing into the fourth flow line 44 is determined by the opening area (cross-sectional area) of the throttle portion 46*c* as well as the cross-sectional area of the auxiliary connector portion 254, and thus the flow rate of the return fluid to the fourth flow line 44 can be increased.

The above configuration enables the flow rate of the return fluid to the fourth flow line 44 to be increased in accordance with the stroke of the spool 50 while controlling the increase of the return fluid to the fourth flow line 44 rapidly due to the synergistic effect of the sixth flow line 46 and the auxiliary connector portion 254.

Figure 3:
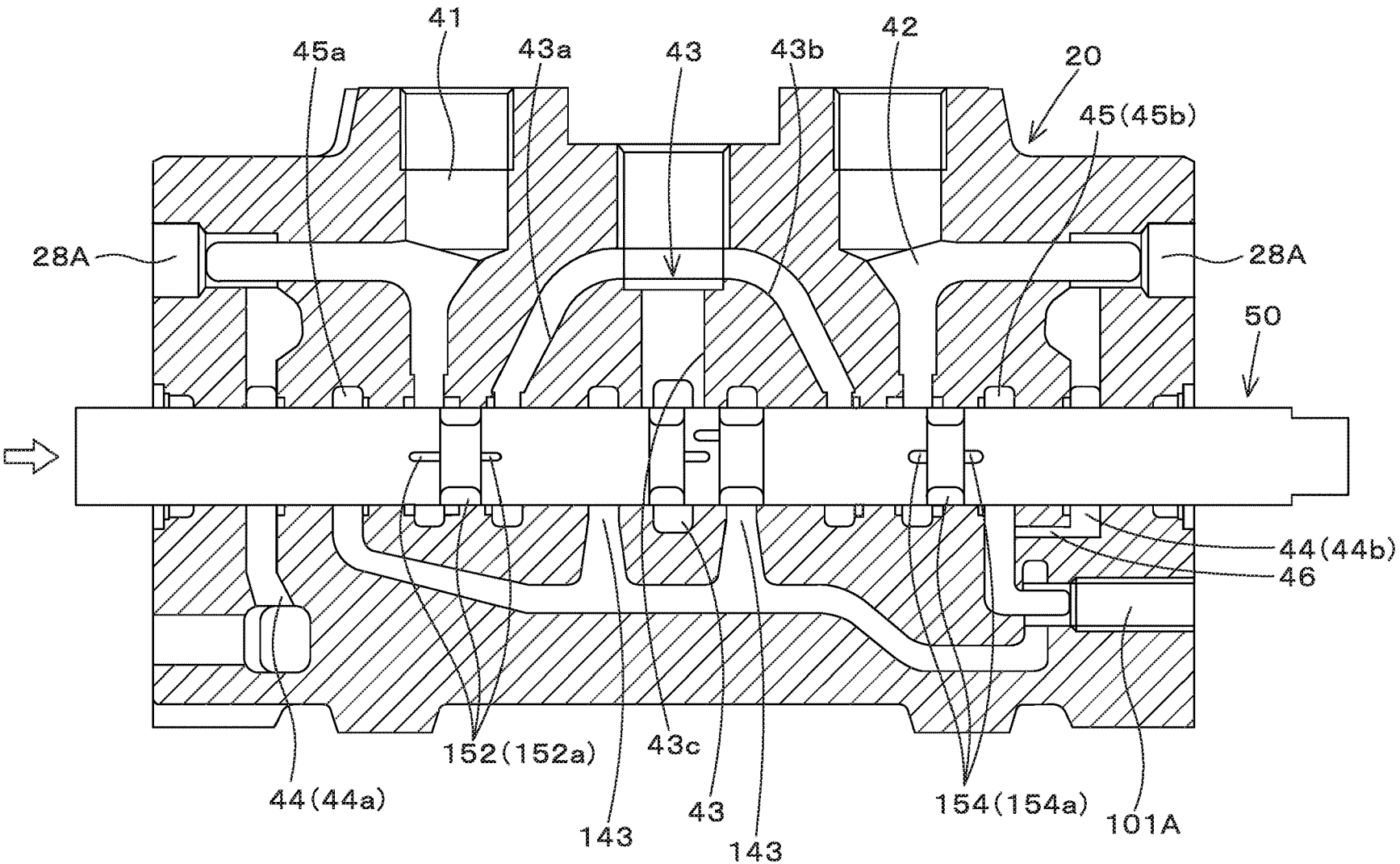
FIG. 3 is a modified example of a flow rate control valve according to an embodiment of the present invention.

FIG. 3 shows the flow control valve 30, which is different in shape from FIG. 2A and FIG. 2B. FIG. 3 shows the state of switching to the second position 20*a*2. As shown in FIG. 3, the flow control valve 30 is also provided with a sixth flow line 46, as shown in FIG. 3.

FIG. 3 is a valve for controlling, for example, the boom cylinder 14 and the bucket cylinder 17. In FIG. 3, the main body 30A differs from FIG. 2A and FIG. 2B, but the function is the same, so that the description of the parts common to FIG. 2A and FIG. 2B will be omitted with the same sign.

In FIG. 3, as in FIG. 1, the fifth flow line 45 is provided with a first check valve 101 (FIG. 3 omitted) that permits the flow of hydraulic fluid from the first control valve 20A to the second control valve 20B and prevents the flow of hydraulic fluid from the second control valve 20B to the first control valve 20A, in the same manner as in FIG. 1.

In other words, at the flow control valve 30 of FIG. 3, some of the return fluid returned from the first hydraulic actuator 14 (the return fluid flowing through the fifth flow line 45) also flows through the sixth flow line 46 to the fourth flow line 44, while other hydraulic fluid can flow toward the first check valve 101 and into the seventh flow line 143.

In the main body 20 of FIG. 3, the first check valve 101 is attached to the portion 101A that is connected to the fifth flow line 45 and the like.

In the above-described embodiment, the second position 20*a*2 side of the first control valve 20A is provided with a sixth flow line 46 or the like that can be connected to the second connecting portion 154, but a sixth flow line 46 or the like that can be connected to the first connector portion 152 may be provided on the first position 20*a*1 side of the first control valve 20A.

In other words, in the first control valve 20A, the first hydraulic actuator 14 can be applied to either the side where the hydraulic actuator 14 stretches or shortens. Similarly, when the sixth flow line 46 or the like is applied to the other control valve of the second control valve 20B, it can be applied to either the side where the hydraulic actuator stretches or shortens, as well.

That is, by movement of the spool 50, the first connector portion 152 can be connected to the first flow line 41, the fifth flow line 45 and the sixth flow line 46. By movement of the spool 50, the second connecting portion 154 can be connected to the second flow line 42, the fifth flow line 45 and the sixth flow line 46.

The flow rate control valve 30 includes the first control valve 20A, the second control valve 20B, the first flow line 41 to connect to the first fluid line 21 connected to the hydraulic actuator, the second flow line 42 to connect to the second fluid line 22 connected to the hydraulic actuator, the third flow line 23 to connect to the third fluid line 23 connected to a hydraulic pump, the hydraulic pump being configured to output operation fluid, the fourth flow line 24 to connect to the operation fluid tank or the fourth fluid line 24 connected to a suction portion of the hydraulic pump, the operation fluid tank storing operation fluid, the fifth flow line 45 to connect the first control valve 20A and the second control valve 20B, the fifth flow line 45 through which operation fluid having flown through the first flow line 41 and the second flow line 42 flows, the spool 50 including the first connecting portion 152 having a first position and a second position, the first connecting portion 153 being configured to connect the first flow line 41 and the third flow line 43 at the first position and to connect the first flow line 41 and the fifth flow line 45 at the second position; and the second connecting portion 154 to connect the second flow line 42 and the third flow line 43 at the second position, and the sixth flow line 46 to connect the fourth flow line 44 and the fifth flow line 45, the sixth flow line 46 being arranged to a location other than the spool 50.

According to this configuration, since the sixth flow line 46 is provided at a different location from the spool 50 and is connected to the fourth flow line 44 and the fifth flow line 45, when the spool 50 is set in the first position 20*a*1, a portion of the hydraulic fluid (return fluid) returning to the second flow line 42 (a portion flowing through the fifth flow line 45) can be outputted into the fourth flow line 44 via the sixth flow line 46.

That is, even when a situation arises in which return fluid cannot be supplied to the second control valve 20B during combined operation of the first control valve 20A and the second control valve 20B, the return fluid returning from the hydraulic actuator to the first control valve 20A can be drained, so that the hydraulic actuator of the first control valve 20A can be operated. It is possible to make the hydraulic actuator feel more comfortable to operate. In other words, the operation of the hydraulic actuator can be improved.

The sixth flow line 46 includes the first connector portion 46*a* in connection with the fifth flow line 45, the second connector portion 46*b* in connection with the fourth flow line 44, and the throttle portion 46*c* connecting the first connector portion 46*a* and the second connector portion 46*b* and having an inner diameter R3 smaller than the inner diameter R1 of the first connector portion 46*a* and the inner diameter R2 of the second connector portion 46*b*.

According to this configuration, the flow rate of the return fluid outputting from the sixth flow line 46 can be adjusted and the first control valve 20A and the second control valve 20B can be operated in a balanced manner.

The second connector portion 46*b* extends to the outer end of the main body 30A and the outer end side is closed by the closing member 47. According to this configuration, the sixth flow line 46 can be easily configured.

The first check valve 101 is provided at the middle portion of the fifth flow line 45 to allow hydraulic fluid to flow from the first control valve 20A to the second control valve 20B and to prevent hydraulic fluid from flowing from the second control valve 20B to the first control valve 20A, and the sixth flow line 46 is located upstream of the first check valve 101.

According to this configuration, the return fluid from the first control valve 20A to the second control valve 20B can be supplied smoothly.

Separate from the fifth flow line 45, the seventh flow line 143 is provided, which is connected to the first control valve 20A and the second control valve 20B and can be connected to the fifth flow line 45.

According to this configuration, the seventh flow line 143 can supply hydraulic fluid from the first control valve 20A to the second control valve 20B, or when the pressure in the fifth flow line 45 is high, the seventh flow line 143 can supply the return fluid to the first control valve 20A again.

The first connector portion 152 can be connected to the first flow line 41, the fifth flow line 45 and the sixth flow line 46. According to this configuration, the hydraulic fluid (return fluid) returned from the hydraulic actuator to the first control valve 20A via the first flow line 41 can flow to the second control valve 20B via the fifth flow line 45, while the hydraulic fluid can be outputted to the fourth flow line 44 via the sixth flow line 46.

The second connecting portion 154 can be connected to the second flow line 42, the fifth flow line 45 and the sixth flow line 46. According to this configuration, the hydraulic fluid (return fluid) returned from the hydraulic actuator to the first control valve 20A via the second flow line 42 can flow to the second control valve 20B via the fifth flow line 45, while outputting to the fourth flow line 44 via the sixth flow line 46.

The spool 50 is provided with the auxiliary connector portion 254 connecting the fifth flow line 45 to the fourth flow line 44. According to this configuration, the auxiliary connector portion 254 also allows the return fluid from the hydraulic actuator back to the fifth flow line to pass through the auxiliary connector portion 254 and discharge the return fluid into the fourth flow line 44.

The sixth flow line 46 may be provided in a control valve other than the first control valve 20A, for example, the second control valve 20B, but is not limited thereto.

The fourth flow line 44 described above connected the first control valve 20A to the hydraulic fluid tank 15. Instead, the fourth flow line 44 may be a flow line connecting the first control valve 20A to the inlet portion of the first hydraulic pump P1 (where the hydraulic fluid is drawn in). Alternatively, the fourth flow line 44 may be a flow line connecting the first control valve 20A to the suction portion of the second hydraulic pump P2.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The fourth flow line 44 described above connected the first control valve 20A to the hydraulic fluid tank 15. Instead, the fourth flow line 44 may be a flow line connecting the first control valve 20A to the inlet portion of the first hydraulic pump P1 (where the hydraulic fluid is drawn in). Alternatively, the fourth flow line 44 may be a flow line connecting the first control valve 20A to the suction portion of the second hydraulic pump P2.

What is claimed is:

1. A flow rate control valve comprising:

a first control valve;

a second control valve;

a first flow line to connect to a first fluid line connected to a hydraulic actuator;

a second flow line to connect to a second fluid line connected to the hydraulic actuator;

a third flow line to connect to a third fluid line connected to a hydraulic pump, the hydraulic pump being configured to output operation fluid;

a fourth flow line to connect to an operation fluid tank or a fourth fluid line connected to a suction portion of the hydraulic pump, the operation fluid tank storing operation fluid;

a fifth flow line to connect the first control valve and the second control valve, the fifth flow line through which operation fluid having flown through the first flow line and the second flow line flows;

a spool including:

a first connecting portion having a first position and a second position, the first connecting portion being configured to connect the first flow line and the third flow line at the first position and to connect the first flow line and the fifth flow line at the second position; and a second connecting portion to connect the second flow line and the third flow line at the second position; and a sixth flow line to connect the fourth flow line and the fifth flow line, the sixth flow line being arranged to a location other than the spool, wherein the sixth flow line includes:

a first connector to connect to the fifth flow line;

a second connector to connect to the fourth flow line; and a throttle to connect the first connector and the second connector, the throttle being configured to connect to the first connector with an inner diameter smaller than another inner diameter with which the second connector connects to the throttle.

2. The flow rate control valve according to claim 1, comprising a first check valve arranged to a middle portion of the fifth flow line and configured to allow operation fluid to flow from the first control valve to the second control valve and to block the operation fluid flowing from the first control valve to the second control valve, wherein the sixth flow line is arranged on an upstream side of the first check valve.

3. The flow rate control valve according to claim 2, comprising a seventh flow line to connect to the fifth flow line, the seventh flow line connecting to the first control valve and the second control valve separating from the fifth flow line.

4. The flow rate control valve according to claim 2, wherein the first connecting portion is configured to connect to the first flow line, the fifth flow line, and the sixth flow line.

5. The flow rate control valve according to claim 2, wherein the second connecting portion is configured to connect to the second flow line, the fifth flow line, and the sixth flow line.

6. The flow rate control valve according to claim 1, comprising a seventh flow line to connect to the fifth flow line, the seventh flow line connecting to the first control valve and the second control valve separating from the fifth flow line.

7. The flow rate control valve according to claim 1, wherein the first connecting portion is configured to connect to the first flow line, the fifth flow line, and the sixth flow line.

8. The flow rate control valve according to claim 1, wherein the second connecting portion is configured to connect to the second flow line, the fifth flow line, and the sixth flow line.

9. A flow rate control valve, comprising:

a first control valve;

a second control valve;

a first flow line to connect to a first fluid line connected to a hydraulic actuator;

a second flow line to connect to a second fluid line connected to the hydraulic actuator;

a third flow line to connect to a third fluid line connected to a hydraulic pump, the hydraulic pump being configured to output operation fluid;

a fourth flow line to connect to an operation fluid tank or a fourth fluid line connected to a suction portion of the hydraulic pump, the operation fluid tank storing operation fluid;

a fifth flow line to connect the first control valve and the second control valve, the fifth flow line through which operation fluid having flown through the first flow line and the second flow line flows;

a spool including:

a first connecting portion having a first position and a second position, the first connecting portion being configured to connect the first flow line and the third flow line at the first position and to connect the first flow line and the fifth flow line at the second position; and a second connecting portion to connect the second flow line and the third flow line at the second position; and a sixth flow line to connect the fourth flow line and the fifth flow line, the sixth flow line being arranged to a location other than the spool, a first check valve arranged to a middle portion of the fifth flow line and configured to allow operation fluid to flow from the first control valve to the second control valve and to block the operation fluid flowing from the second control valve to the first control valve, wherein the sixth flow line is arranged on an upstream side of the first check valve.

10. The flow rate control valve according to claim 9, comprising a seventh flow line to connect to the fifth flow line, the seventh flow line connecting to the first control valve and the second control valve separating from the fifth flow line.

11. The flow rate control valve according to claim 9, wherein the first connecting portion is configured to connect to the first flow line, the fifth flow line, and the sixth flow line.

12. The flow rate control valve according to claim 9, wherein the second connecting portion is configured to connect to the second flow line, the fifth flow line, and the sixth flow line.

13. A flow rate control valve comprising a main body including a first control valve and a second control valve, the main body comprising:

a first body port and a second body port, each of the first and second body ports configured to be connected to a hydraulic actuator;

a third body port configured to receive operation fluid from a hydraulic pump;

a fourth body port configured to discharge the operation fluid outside the main body;

a first flow line connected to the first body port;

a second flow line connected to the second body port;

a third flow line connected to the third body port;

a fourth flow line connected to the fourth body port;

a fifth flow line connected between the first control valve and the second control valve;

a wall portion formed in the main body to define a through hole extending in a longitudinal direction;

a spool inserted in the through hole and configured to move along the longitudinal direction from a neutral position to a first position or a second position, the spool having a first concave portion to define a first connector portion in conjunction with the wall portion, a second concave portion to define a second connector portion in conjunction with the wall portion;

the spool being configured to connect the first flow line to the third flow line through the first connector portion and to connect the second flow line to the fifth flow line through the second connector portion at the first position; and the spool being configured to connect to connect the first flow line to the fifth flow line through the first connector portion and to connect the second flow line to the third flow line through the second connector portion at the second position, wherein the main body further comprises a sixth flow line connected between the fourth flow line and the fifth flow line, the sixth flow line extending in the longitudinal direction and away from the wall portion.

14. The flow rate control valve according to claim 13, wherein the sixth flow line includes:

a first connector to connect to the fifth flow line;

a second connector to connect to the fourth flow line; and a throttle between the first connector and the second connector, having an inner diameter smaller than inner diameters of the first connector and the second connector.

15. The flow rate control valve according to claim 13, wherein a first check valve arranged in the fifth flow line and configured to allow the operation fluid to flow from the first control valve to the second control valve and to block the operation fluid flowing from the second control valve to the first control valve, wherein the sixth flow line is arranged on an upstream side of the first check valve.

16. The flow rate control valve according to claim 13, wherein the spool defines an auxiliary connector portion in conjunction with the wall portion, and is configured to connect the fourth flow line to the fifth flow line through the auxiliary connector portion at the first position.

* * * * *